US010646976B2

(12) United States Patent
Ishitsuka et al.

(10) Patent No.: US 10,646,976 B2
(45) Date of Patent: May 12, 2020

(54) METHOD FOR PRODUCING SUBSTRATE

(71) Applicant: SHIN-ETSU CHEMICAL CO., LTD., Tokyo (JP)

(72) Inventors: Yoko Ishitsuka, Joetsu (JP); Atsushi Watabe, Joetsu (JP); Masaki Takeuchi, Joetsu (JP)

(73) Assignee: SHIN-ETSU CHEMICAL CO., LTD., Tokyo (JP)

( * ) Notice: Subject to any disclaimer, the term of this patent is extended or adjusted under 35 U.S.C. 154(b) by 0 days.

(21) Appl. No.: 15/682,821

(22) Filed: Aug. 22, 2017

(65) Prior Publication Data

US 2018/0056475 A1 Mar. 1, 2018

(30) Foreign Application Priority Data

Aug. 23, 2016 (JP) ..... 2016-162363

(51) Int. Cl.

| | |
|---|---|
| ***B24B 29/00*** | (2006.01) |
| ***B24B 7/07*** | (2006.01) |
| ***B24B 1/00*** | (2006.01) |
| ***B24B 37/16*** | (2012.01) |
| ***B24B 23/02*** | (2006.01) |

(52) U.S. Cl.

CPC ..... *B24B 29/00* (2013.01); *B24B 1/00* (2013.01); *B24B 7/07* (2013.01); *B24B 23/02* (2013.01); *B24B 37/16* (2013.01)

(58) Field of Classification Search

CPC ..... B24B 29/00; B24B 23/02
USPC ..... 451/41, 42, 5, 8, 259, 59
See application file for complete search history.

(56) References Cited

U.S. PATENT DOCUMENTS 2,399,924 A * 5/1946 Hayward ..... B24B 13/015 451/259
4,606,151 A * 8/1986 Heynacher ..... B24B 13/015 451/168

(Continued)

FOREIGN PATENT DOCUMENTS

CN 103231320 B 3/2015
EP 272362 A2 6/1988

(Continued)

OTHER PUBLICATIONS

Extended European Search Report for European Application No. 17186941.5, dated Jan. 18, 2018.

*Primary Examiner* — Robert A Rose
(74) *Attorney, Agent, or Firm* — Birch, Stewart, Kolasch & Birch, LLP

(57) ABSTRACT

There is furnished a working tool comprising a rotating shaft (6), a polishing plate (3) mounted on the shaft, an expandable elastomer sheet (4) attached to the polishing plate (3), an abrasive cloth (5) attached to the elastomer sheet (4), and means for pressing the elastomer sheet (4) at a plurality of positions under respective predetermined different pressures such that a lower surface of the abrasive cloth (5) is deformed to the desired inverted convex shape in accordance with differences of pressing force applied to the elastomer sheet (4) at the plurality of positions. A substrate is produced by bringing the inverted convexly deformed surface of the abrasive cloth (5) in contact with a substrate stock, and rotating and moving the working tool for polishing the substrate over a selected area.

4 Claims, 2 Drawing Sheets

(56) References Cited

U.S. PATENT DOCUMENTS

| | | | | |
|---|---|---|---|---|
| 4,802,309 | A * | 2/1989 | Heynacher | B24B 13/015 451/168 |
| 5,720,845 | A * | 2/1998 | Liu | B24B 37/30 156/345.13 |
| 6,432,258 | B1 | 8/2002 | Kimura et al. | |
| 8,460,061 | B2 * | 6/2013 | Shibano | C03C 19/00 451/41 |

FOREIGN PATENT DOCUMENTS

| | | | |
|---|---|---|---|
| EP | 2 236 246 | A1 | 10/2010 |
| JP | 2008-229846 | A | 10/2008 |
| JP | 2010-064196 | A | 3/2010 |
| JP | 2010-254552 | A | 11/2010 |
| WO | WO 00/32353 | A2 | 6/2000 |

* cited by examiner

METHOD FOR PRODUCING SUBSTRATE

CROSS-REFERENCE TO RELATED APPLICATION

This non-provisional application claims priority under 35 U.S.C. § 119(a) on Patent Application No. 2016-162363 filed in Japan on Aug. 23, 2016, the entire contents of which are hereby incorporated by reference.

TECHNICAL FIELD

This invention relates to a method for producing substrates, especially large-size synthetic quartz glass substrates.

BACKGROUND ART

In general, synthetic quartz glass substrates are manufactured by cutting a synthetic quartz glass block into plates by a cutting tool such as wire saw, lapping the glass plates with an abrasive slurry, and polishing the glass plates until the desired size, thickness and flatness are reached.

When high-precision large-size synthetic quartz glass substrates required to have a high surface flatness are manufactured, the steps of measuring a substrate surface for topological distribution of raised and recessed portions, and partially polishing away the raised portions on the substrate surface on the basis of the measured data are necessary in order to achieve the desired surface accuracy.

As the method for partially controlling a polishing allowance on a substrate surface, Patent Document 1 proposes a method of selecting one tool from a plurality of tools having different working areas, and controlling the rate of moving the tool in accordance with a particular position on a substrate, for thereby controlling a polishing allowance at each position. Also, Patent Document 2 describes a method of moving forward and backward a polishing tool on a substrate, the polishing tool having a smaller polishing surface than the surface of the substrate to be polished, and controlling the pressure applied to the polishing tool through a pressure fluid. Patent Document 3 describes a method of polishing a substrate, comprising the steps of applying a pressure fluid to the substrate from its back surface to partially pressurize the substrate, and forcing abrasive cloth to the substrate via a jig.

CITATION LIST

Patent Document 1: JP-A 2010-254552 (U.S. Pat. No. 8,460,061, EP 2236246)

Patent Document 2: JP-A 2010-064196

Patent Document 3: JP-A 2008-229846

SUMMARY OF INVENTION

In the step of partially polishing away raised portions on a substrate surface, the thickness of the overall substrate is adjusted at the same time. If the contact area between the working face of the working tool and the substrate is small, then this step is effective for partial polishing away raised portions, but requires a longer work time for overall thickness adjustment. If the contact area between the working face of the working tool and the substrate is large, then the polishing time required for overall thickness adjustment becomes shorter, but during polishing of raised portions, surrounding portions are widely polished, indicating the difficulty of precise control of surface accuracy. Since the method of Patent Document 1 includes the steps of selecting one tool from a plurality of tools having different working areas and traversing it across the substrate, the exchange of tools during the process is cumbersome, adding to the working time. In Patent Document 2, a substrate on a rotating stage is polished by moving a working tool back and forth. Since the removal allowance on the substrate is controlled only in terms of distribution in substrate diametrical direction, it is difficult to selectively remove partial raised portions on the substrate. In Patent Document 3 wherein the polishing face of abrasive cloth is in contact with the overall substrate, the overall substrate is polished rather than selectively polishing away only raised portions. Then the final substrate removal allowance becomes large and the working time becomes long.

An object of the invention is to provide a method for producing a substrate, capable of precision polishing without a need to exchange a working tool.

The inventors have found that a substrate is polished by using a working tool comprising a polishing plate, an abrasive cloth, and an elastomer sheet interposed therebetween, and operating the working tool while deforming the surface of the abrasive cloth to be inverted convexly in accordance with differences of pressing force applied to the elastomer sheet at a plurality of positions. Then the time taken for exchange of the working tool is eliminated.

The invention provides a method for producing a substrate, comprising the steps of:

furnishing a working tool comprising a rotatably mounted polishing plate, an expandable elastomer sheet attached to a lower surface of the polishing plate, an abrasive cloth attached to a lower surface of the elastomer sheet, and means for pressing the elastomer sheet at a plurality of positions under respective predetermined different pressures such that a lower surface of the abrasive cloth is deformed to the desired inverted convex shape in accordance with differences of pressing force applied to the elastomer sheet at the plurality of positions, bringing the inverted convexly deformed surface of the abrasive cloth in contact with a substrate, and rotating and moving the working tool for polishing the substrate over a selected area.

In a preferred embodiment, the pressing means includes a plurality of bores perforated in the polishing plate and arranged symmetrical about its center, a plurality of cylinders inserted in the bores, and a plurality of pistons slidably fitted in the cylinders, wherein as the pistons are selectively descended, the elastomer sheet is forced downward at sites opposed to the pistons in accordance with descending distances of the pistons whereby a selected region of the abrasive cloth is protruded downward to form the desired inverted convex shape.

In preferred embodiments, the elastomer sheet is made of an expandable elastomer selected from the group consisting of silicone rubber, polyurethane rubber, neoprene rubber, and isoprene rubber; the abrasive cloth is non-woven fabric, suede or expanded polyurethane; and the substrate is a synthetic quartz glass substrate having a diagonal length of at least 1,000 mm.

Advantageous Effects of Invention

When a substrate surface is corrected in flatness and adjusted in thickness, it is possible to selectively polish away raised portions on the substrate and adjust the thickness of the overall substrate using a single working tool without a need to exchange the tool. Since the cumbersome step of tool exchange is eliminated, brief polishing is possible and productivity is increased. Substrates can be economically manufactured.

DESCRIPTION OF PREFERRED EMBODIMENTS

Figure 1:
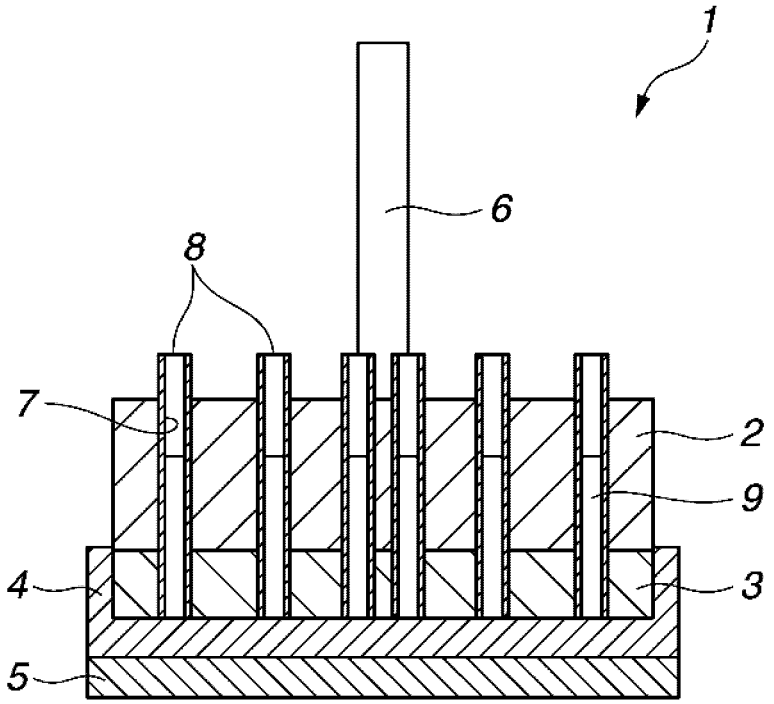
FIG. 1 is a schematic cross-sectional view of a working tool according to one embodiment of the invention.

In the following description, like reference characters designate like or corresponding parts throughout the several views shown in the figures. It is also understood that terms such as "upper," "lower," "outward," "inward," and the like, which are used in conjunction with the elevational view of FIG. 1, are words of convenience and are not to be construed as limiting terms.

Referring to FIG. 1, there is illustrated one exemplary working tool 1 used in the practice of the inventive method. The working tool 1 includes a base 2 of short-axis cylinder shape, a disk-shaped polishing plate 3 attached to a lower surface of the base 2, an elastomer sheet 4 attached to a lower surface of the polishing plate 3 for expansion and contraction in a vertical direction (or thickness direction of elastomer sheet 4), and an abrasive cloth 5 secured to a lower surface of the elastomer sheet 4. A rotating shaft 6 at its lower end is secured to the upper surface of the base 2 at its center. The shaft 6 is coupled to a rotating mechanism (not shown). When the rotating mechanism is actuated, the rotating shaft 6 rotates, and the base 2, polishing plate 3, elastomer sheet 4 and abrasive cloth 5 rotate integrally therewith.

Figure 2:
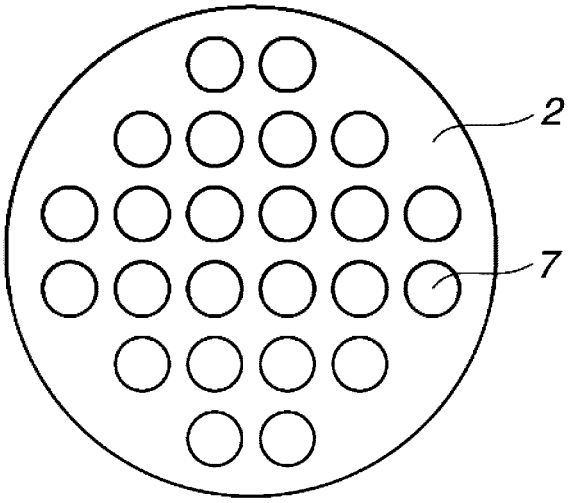
FIG. 2 is a plan view of one exemplary polishing plate having bores, with the rotating shaft being omitted.
Figure 3:
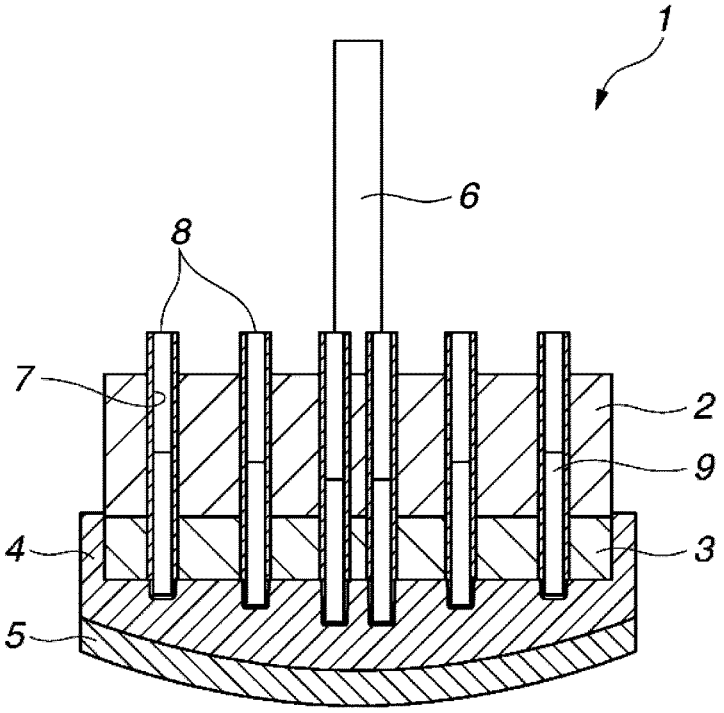
FIG. 3 is a cross-sectional view of the working tool of FIG. 1, showing the inverted convexly deformed state of abrasive cloth.
Figure 4:
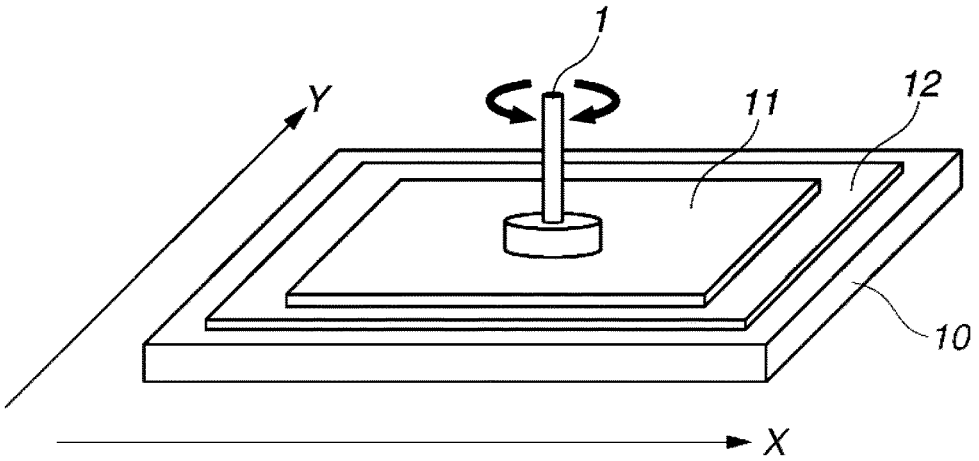
FIG. 4 schematically illustrates how to operate the working tool.

As shown in FIG. 2, the base 2 and polishing plate 3 are perforated with a plurality of through bores 7 which are arranged symmetrical about the center and spaced apart a predetermined distance. A hollow cylinder 8 is inserted in each through bore 7. A piston 9 is slidably fitted in each cylinder 8. The piston 9 is descended (moved downward) by feeding air into the cylinder 8 against the upper end of the piston 9 to apply a pneumatic pressure thereto. The descending distance of each piston 9 can be controlled in accordance with the magnitude of pneumatic pressure applied thereto. As the pistons 9 are descended, the abrasive cloth 5 is forced downward by the lower ends of the pistons 9 via the elastomer sheet 4 in proportion to the descending distances whereby the abrasive cloth 5 is protruded downward and convexly. The hydraulic pressures applied to the plurality of pistons 9 are controlled such that those pistons 9 arranged near the center are moved more downward whereas those pistons 9 arranged near the periphery are moved less downward. Then, the abrasive cloth 5 takes an arcuate (or inverted convex) shape, with the central area being protruded downward as shown in FIG. 3. Since the elastomer sheet 4 is interposed between the abrasive cloth 5 and the polishing plate 3 according to the invention, the polishing face of the abrasive cloth 5 is deformed to an arbitrary convex shape relative to the polishing plate 3 via the elastomer sheet 4. In this state, the tool is moved across the substrate (as shown in FIG. 4) for selectively polishing raised portions on the substrate. Notably, the deformation of the abrasive cloth 5 by arbitrary pressing forces corresponding to the controlled hydraulic pressures applied to the pistons 9 may also be accomplished by connecting rods to the pistons and independently moving the pistons via the rods by a drive mechanism (not shown).

The polishing plate is preferably made of a metal material selected from among stainless steel (SUS), aluminum alloys, titanium, and brass. The polishing plate preferably has a diameter of 100 to 800 mm, more preferably 300 to 600 mm. Preferably the through bores in the polishing plate have a diameter of 20 to 50 mm and are spaced apart a distance of at least 10 mm. Also preferably 4 to 28, more preferably 8 to 20, and even more preferably 10 to 16 bores are arranged symmetrical about the center of the polishing plate. While the pneumatic pressures applied axially through the bores act to press the elastomer sheet under a pressure in the range of 0.01 to 0.05 MPa, the deformation of the elastomer sheet can be controlled in proportion to the magnitude of pressing force applied to each piston in the tool.

The elastomer sheet is preferably made of an expandable elastomer selected from silicone rubber, polyurethane rubber, neoprene rubber, and isoprene rubber. The diameter of the elastomer sheet is equal to the diameter of the tool. The thickness of the elastomer sheet is determined in consideration of deformation, degradation or abrasion of the sheet and is preferably in a range of 5 to 20 mm, more preferably 10 to 15 mm.

The abrasive cloth is preferably selected from non-woven fabric, suede and expanded polyurethane and is secured to the elastomer sheet with an adhesive. The adhesive used herein is not particularly limited as long as it has a sufficient bond strength to prevent the abrasive cloth from separating from the elastomer sheet during polishing operation. Acrylic, epoxy and urethane based adhesives are suitable.

Reference is now made to an example using a polishing plate 2 of stainless steel SUS304 with a diameter 300 mm in which circular bores 7 having a diameter 20 mm are arranged about the center as shown in FIG. 2. Polyurethane rubber of thickness 10 mm is attached to the polishing plate as an elastomer sheet. If equal hydraulic pressures are applied to the pistons 9 through the bores 7, the elastomer sheet 4 and abrasive cloth 5 take planar shape as shown in FIG. 1. When the hydraulic pressure applied to the elastomer sheet at remoter positions is more reduced as compared with the hydraulic pressure applied to the elastomer sheet near the center, the distance of displacement due to deformation by pressing forces is greater at a position nearer to the center of the elastomer sheet. Then the elastomer sheet 4 and abrasive cloth 5 take inverted convex shape as shown in FIG. 3. The selection of cylinders, the extent of pressing of a selected portion of the elastomer sheet, and the extent of convexity (protrusion) may be determined in accordance with a removal allowance and shape of the substrate.

According to the method, a synthetic quartz glass substrate stock having a diagonal length of at least 1,000 mm may be polished by furnishing the working tool having an elastomer sheet between an abrasive cloth and a polishing plate, applying different pressing forces to the tool at plural positions to deform the abrasive cloth face to inverted convex shape, and moving the tool across the substrate. The desired substrate is produced in this way.

In practice, the process of polishing a substrate includes the following steps of:

(1) measuring a flatness and parallelism of front and back surfaces of a substrate stock, (2) computing an amount of material removal and a moving rate of the working tool when the substrate stock is polished under first pressing conditions by forcing the abrasive cloth against the substrate stock, (3) working under the first pressing conditions based on the computed data of (2), (4) computing the shape (or topography) of the substrate worked under the first pressing conditions, and computing an amount of material removal and a moving rate of the working tool when the substrate stock is polished under second pressing conditions by forcing the abrasive cloth against the substrate stock, and (5) working under the second pressing conditions based on the computed data of (4).

These steps are described in detail.

(1) Measuring Flatness and Parallelism of Front and Back Surfaces of Substrate Stock Step (1) is to measure a flatness and parallelism of front and back surfaces of a substrate stock while the substrate stock is held vertically. Preferably the substrate stock is previously given a certain parallelism by a double-side lapping machine. Measurement of flatness may be carried out using a flatness meter, for example, commercially available from Kuroda Precision Industries Ltd. Parallelism may be measured by a micrometer, for example, commercially available from Mitsutoyo Corp. Provided that a least square plane computed from a substrate stock surface is used as a reference plane, the flatness is the sum of a maximum of the distance between a raised portion on the substrate surface and the reference surface and a maximum of the distance between a recessed portion on the substrate surface and the reference surface. The parallelism is the difference between a maximum and a minimum of the distance between the front and back surfaces of the substrate stock.

(2) Computing Amount of Material Removal in Polishing and Moving Rate of the Working Tool when the Substrate Stock is Polished Under First Pressing Conditions by Forcing the Abrasive Cloth Against the Substrate Stock The measurement data (flatness data at various points within substrate) of step (1) are stored in a computer as height data. Based on these data, an amount of material removal in polishing necessary for the substrate to become flat on each of front and back surfaces is computed. For each of front and back surfaces, a flat worked surface is a surface which is parallel to an average plane for each of front and back surfaces and tangent to the most recessed point in the surface under measurement.

Next, the parallelism of the substrate which has become flat on both surfaces is determined by calculation. From the parallelism thus determined, an amount of material removal in polishing is computed. The amount of material removal in polishing is determined such that the thickness is coincident with the thinnest portion of the substrate which has become flat. In this way, an amount (I) of material removal in polishing at each ideal plane and each ideal point is determined from the measurement data of flatness and parallelism of front and back surfaces of the substrate stock.

On the basis of the amount (I) of material removal in polishing at each ideal plane and each ideal point, a polishing profile is examined by polishing substrate stocks having substantially the same size and the same flatness and parallelism on front and back surfaces under the first pressing conditions, while the moving rate and rotational speed of the working tool and the type of abrasive cloth are changed, for thereby previously computing an amount of material removal in polishing. On the basis of the polishing profile, an amount (II) of material removal in polishing at each plane and each point under the first pressing conditions and the moving rate of the working tool are computed.

(3) Working Under First Pressing Conditions Based on the Computed Data of (2)

When the substrate stock is worked under the first pressing conditions on the basis of the amount (II) of material removal in polishing and the moving rate of the working tool in step (2), desirably a pressure of 0.01 to 0.015 MPa causing a relatively small deformation of the elastomer sheet is uniformly applied to the elastomer sheet through the cylinders. When the pressing conditions are uniform within the polishing plane, the contact area of the polishing plane is equal to the tool area, and the polishing area is large. Then general accuracy correction and thickness adjustment of the overall substrate are completed within a relatively short time.

FIG. 4 is a perspective view of a working apparatus. Depicted in FIG. 4 are a working tool 1, a substrate holder 10, a substrate 11, and a back pad 12. For working, on a portion accompanied with a large amount of material removal, the moving rate of the working tool is reduced to extend the resident time. On a portion accompanied with a small amount of material removal, the moving rate of the working tool is increased to shorten the resident time. The amount of material removal at each position on the substrate is controlled in this way. The working tool is of such structure that it may be arbitrarily moved in X and Y axis directions, and the movement of the working tool is computer controllable.

The working tool is coupled to a rotating mechanism for rotating the shaft 6. The rotational count of the working tool is preferably set in consideration of splashing of the abrasive slurry out of the apparatus and working time, and specifically to 30 to 300 rpm, especially 30 to 120 rpm. The working tool is coupled to the rotating shaft 6 through a universal joint such that the working tool may follow any gradient of the substrate surface.

Although the abrasive slurry used herein is not particularly limited, it is preferably selected from slurries of cerium oxide, colloidal silica and silicon carbide grains as commonly used in the art. Abrasive grains preferably have an average particle size of 0.02 to 3 μm, more preferably 0.05 to 1 μm. The abrasive slurry may be injected through the working tool, or the substrate is polished while it is kept immersed in the abrasive slurry. Abrasive grains are preferably present in the abrasive slurry in a concentration of 10 to 50% by weight, more preferably 10 to 40% by weight, and even more preferably 10 to 25% by weight. Where the working tool is rotated and oscillated in order to promote entry of the abrasive slurry onto the polishing surface, the polishing profile under these conditions is pre-examined, and the moving rate is computed based on the pre-examined data.

The working procedure may include continuously traversing the working tool parallel to X axis direction at the computed rate and thereafter, feeding the tool in Y axis direction at a certain pitch. The feed pitch in Y axis direction is preferably up to 30%, more preferably 10 to 25% of the diameter of the polishing plate, in consideration of flatness correction and working time under second pressing conditions. Specifically, the working tool is preferably traversed parallel to X axis direction at the rate of 0.05 to 300 mm/min, more preferably 2 to 50 mm/min. The tool is preferably fed in Y axis direction at the pitch of 1 to 200 mm, more preferably 5 to 100 mm.

(4) Computing the Shape of the Substrate Worked Under First Pressing Conditions, and Computing an Amount of Material Removal in Polishing and a Moving Rate of the Working Tool when the Substrate Stock is Polished Under Second Pressing Conditions by Forcing the Abrasive Cloth Against the Substrate Stock With only the working under the first pressing conditions, the actual amount of material removal differs in some portions from the amount (I) of material removal in polishing at each ideal plane and each ideal point obtained from the measurement of flatness and parallelism at front and back surfaces of the substrate stock. Therefore, to eliminate the difference, polishing with the working tool under second pressing conditions is carried out to polish those portions which have not been fully worked under the first pressing conditions, for example, four corners of the substrate and local raised portions. Specifically, from the data of flatness and parallelism prior to working with the working tool under second pressing conditions which have been previously determined by computation, based on the data of the polishing profile using the working tool under the first pressing conditions, an amount of material removal in polishing necessary for working with the working tool under second pressing conditions to reach the amount (I) of material removal and a moving rate of the working tool are computed. In this case, like working under the first pressing conditions, the polishing profile with the working tool under second pressing conditions is pre-examined, and the moving rate of the working tool is adjusted accordingly. Thus, the invention ensures efficient working since accuracy measurement is not needed after working under first pressing conditions.

(5) Working Under Second Pressing Conditions Based on the Computed Data of (4)

The substrate is worked with the working tool under the second pressing conditions in accordance with the amount of material removal in polishing and the moving rate of the working tool computed in step (4). To correct more finely the flatness of the substrate which has been worked under the first pressing conditions, working under the second pressing conditions is carried out while the working area of the working tool is reduced from that under the first pressing conditions. With respect to the pressures applied to the elastomer sheet through bores in the polishing plate, the pressure applied near the center of the polishing plate is set greater than the pressure applied near the periphery of the polishing plate, whereby the central portion of the elastomer sheet is protruded to an extent of 2 to 10% of the original thickness, specifically 0.1 to 2.0 mm, that is, polishing is carried out while the elastomer sheet is more convex shaped than under the first pressing conditions. The shape of the abrasive cloth is deformed in conformity to the deformation of the elastomer sheet, and the shape of the contact face with the substrate is deformed. Since the contact face is deformed convex (inverted convex), removal allowances at the center and the periphery of the working tool vary, such that the removal allowance at the center of the working tool is relatively greater than the removal allowance at the periphery of the working tool, enabling finer correction of flatness of the substrate. Specifically, the elastomer sheet is deformed into a central convex shape (inverted convex shape) by applying a pressure of 0.02 to 0.04 MPa near the center of the polishing plate, gently reducing the pressure from the center toward the periphery of the polishing plate, and applying a pressure of 0.01 to 0.02 MPa near the periphery of the polishing plate. Provided that the distance (or radius) from the center to the periphery of the polishing plate is 100, a portion of the polishing plate having a radial distance of 0 to 30 from the center is referred to as the central portion, and a portion of the polishing plate having a radial distance of 70 to 100 is referred to as the peripheral portion. When the shape of the contact area between the abrasive cloth and the substrate under second pressing conditions is more convex than that under first pressing conditions, a flatness correction effect becomes greater, but the contact area with the substrate becomes smaller. If the contact area is too small, then the necessary working time becomes longer, adversely affecting economy. Thus the deformation amount of the elastomer sheet is determined in accordance with the desired flatness and working time.

The working is carried out in the same manner as the working under first pressing conditions. Specifically, under second pressing conditions, the working tool is preferably traversed parallel to X axis direction at the rate of 0.05 to 300 mm/min, more preferably 2 to 50 mm/min. The tool is preferably fed in Y axis direction at the pitch of 1 to 50 mm, more preferably 5 to 30 mm. Combination of working under first pressing conditions with working under second pressing conditions may prevent streaks from forming on the substrate. If necessary, polishing step may follow. Depending on the desired working accuracy, a choice may be made among three or more pressing conditions such as third pressing conditions and fourth pressing conditions.

According to the inventive method, by controlling pressing conditions of a working tool, the removal allowance distribution on the polishing surface can be controlled, without a need for exchange of the working tool. The method is effective in correcting for flatness and parallelism a substrate stock within a short time, and successful in producing a substrate with a high flatness and parallelism.

A substrate stock to be worked according to the invention should preferably have a diagonal length of at least 1,000 mm, more preferably 1,000 to 3,500 mm, and even more preferably 1,500 to 3,000 mm. The shape of a substrate may be square, rectangular, circular or otherwise. In the case of circular shape, the diagonal length is interpreted as diameter. The thickness of a large-size substrate is not particularly limited, although it is preferably 5 to 50 mm, more preferably 10 to 20 mm.

Preferably the substrate produced is highly flat as demonstrated by a flatness/diagonal length of up to $8\times10^{-6}$, more preferably up to $6\times10^{-6}$, and even more preferably up to $5\times10^{-6}$. The lower limit of flatness/diagonal length is typically $1\times10^{-6}$, though not critical.

Also preferably the substrate produced has a parallelism of up to 50 μm, more preferably up to 30 μm, and even more preferably up to 10 μm, in consideration of correction operation for minimizing a variation of exposure gap when the substrate is mounted in the exposure tool.

With the inventive method, a substrate stock may be corrected for flatness and parallelism within a short time, yielding a substrate having a high flatness and parallelism. A photomask may be prepared using the substrate and used in panel exposure to achieve an improvement in CD accuracy and enable exposure of a fine feature pattern. This may eventually lead to improvements in the manufacture yield of panels.

EXAMPLE

Examples and Comparative Examples are given below although the invention is not limited thereto.

Example 1

A synthetic quartz glass substrate stock was furnished by lapping both surfaces of a synthetic quartz glass substrate stock having a size of 1600 mm×1800 mm×17.5 mm (thick). The roughly lapped substrate stock had a flatness of 100 μm on a front surface, a flatness of 120 μm on a back surface, and a parallelism of 50 μm. The flatness was measured by a flatness tester by Kuroda Precision Industries Ltd., and the parallelism was measured by a micrometer by Mitsutoyo Corp. From the measured data of flatness and parallelism, amounts of material removal in polishing on each of front and back surfaces and at each point were determined.

As shown in FIG. 4, this substrate stock 11 was rested on a back pad 12 of expanded polyurethane bonded to a substrate holder 10 and secured thereto by surrounding the periphery of the substrate stock with a resin frame. The working tool was constructed from a polishing plate of stainless steel SUS304 having a diameter of 500 mm, an elastomer sheet of polyurethane rubber having a diameter of 500 mm and a thickness of 10 mm, and an abrasive cloth of polyurethane attached thereto. The abrasive slurry used herein was a suspension of cerium oxide grains having an average particle size of 1 μm in water in a concentration of 20 wt %.

Synthetic quartz glass substrates having the same size and the same flatness and parallelism on front and back surfaces were used as the substrate stock. The deformation of the abrasive cloth face and the polishing profile when the extent of convexity (or protrusion) by the pressing mechanism was changed was previously determined. In accordance with the determined data, the working tool was continuously moved parallel to X axis direction and fed in Y axis direction a pitch corresponding to 100 mm. The moving speed of the working tool in X axis direction was 30 mm/min at minimum and the rotational count of the tool was 60 rpm.

First, working was carried out while applying a uniform pressure of 0.01 MPa to the polyurethane rubber through the bores, as first pressing conditions, for thereby achieving general flatness correction over a relatively wide range and overall thickness equalization, approaching to the desired distribution of material removal in polishing.

Next, as second pressing conditions, the pressure applied to the polyurethane rubber through those bores arranged near the center of the polishing plate was 0.03 MPa, the pressure applied to the polyurethane rubber through the bores was gently reduced from the center to the periphery of the polishing plate, and the pressure applied to the polyurethane rubber through those bores arranged near the periphery of the polishing plate was 0.01 MPa. whereby the central portion of the elastomer was protruded 2 mm beyond the original. Under these pressing conditions, the elastomer sheet and abrasive cloth were deformed more convex (inverted convex) than under the first pressing conditions so that the width of polishing profile at the working surface was reduced, achieving removal of raised portions in a narrow range on the substrate and fine accuracy correction at the four corners of the substrate. On the basis of the data of flatness and parallelism prior to working under the second pressing conditions, which was previously computed from the foregoing working profile, a necessary amount of material removal in polishing under the second pressing conditions was computed and a moving rate of the working tool under the second pressing conditions was determined. Under the second pressing conditions, the traverse rate in X axis direction of the working tool was 30 mm/min at minimum, the feed pitch in Y axis direction was 30 mm, and the tool was rotated at 60 rpm. The moving rates of the working tool across different portions of the substrate were computed from the necessary amount of material removal in polishing for each portion, based on the previously examined polishing profile under second pressing conditions. After the front surface was worked, the back surface was worked. Table 1 shows the polishing times under the first and second pressing conditions and the data of flatness, parallelism and working allowance after working. The necessary working time is expressed in relative values based on the value of 100 for Comparative Example 1.

Example 2

There was furnished a synthetic quartz glass substrate stock having a size of 800 mm×900 mm×8.3 mm (thick) and having a flatness of 80 μm on a front surface, a flatness of 100 μm on a back surface, and a parallelism of 40 μm. It was worked under the same conditions as in Example 1, with the results shown in Table 1. The time finally required for working was about ¼ of Example 1.

Comparative Example 1

There was furnished a synthetic quartz glass substrate stock having the same size as in Example 1. It was worked only under the first pressing conditions, without any change of pressing conditions of the working tool. The results are shown in Table 1. Since the contact area between the working tool and the substrate was large, it was accordingly difficult to effectively polish away local raised portions, and an extra working allowance was necessary. Additionally, the final flatness was larger than in Example 1.

Comparative Example 2

There was furnished a synthetic quartz glass substrate stock having the same size as in Example 1. The procedure of Example 1 was followed until the first working. Thereafter, the working tool was replaced by a second working tool having a smaller diameter of 100 mm in which an abrasive cloth is directly attached to a polishing plate without elastomer sheet. The moving rate of the second working tool was computed in accordance with the working allowance distribution of the second working tool, and raised portions were removed by abrasive working. The results are shown in Table 1. The final flatness and allowance volume were substantially equal to Example 1, but the final working time was longer than in Example 1 because an extra time was consumed in the replacement of working tool.

Comparative Example 3

There was furnished a synthetic quartz glass substrate stock having the same size as in Example 2. The procedure of Example 2 was followed until the first working. Thereafter, the working tool was replaced by a second working tool having a smaller diameter of 100 mm in which an abrasive cloth is directly attached to a polishing plate without elastomer sheet. The moving rate of the second working tool was computed in accordance with the polishing profile of the second working tool, and raised portions were removed by abrasive working. The results are shown in Table 1. The final flatness and allowance volume were substantially equal to Example 2, but the final working time was longer than in Example 2 because an extra time was consumed in the replacement of working tool.

TABLE 1

| | | Substrate size (mm) | Prior to polishing: Flatness of front surface (μm) | Prior to polishing: Flatness of back surface (μm) | Prior to polishing: Parallelism (μm) | After polishing: Flatness of front surface (μm) | After polishing: Flatness of back surface (μm) | After polishing: Parallelism (μm) | Working allowance (μm) | Working time required (%) |
|---|---|---|---|---|---|---|---|---|---|---|
| Example | 1 | 1,600 × 1,800 | 100 | 120 | 50 | 15 | 15 | 10 | 100 | 105 |
| | 2 | 800 × 900 | 80 | 100 | 40 | 15 | 15 | 10 | 100 | 26 |
| Comparative Example | 1 | 1,600 × 1,800 | 95 | 130 | 38 | 22 | 24 | 15 | 140 | 100 |
| | 2 | 1,600 × 1,800 | 100 | 115 | 39 | 14 | 14 | 11 | 100 | 122 |
| | 3 | 800 × 900 | 80 | 100 | 40 | 15 | 15 | 10 | 100 | 43 |

Japanese Patent Application No. 2016-162363 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for producing a substrate, comprising the steps of:

furnishing a working tool comprising a polishing plate which is disk-shaped and is rotatably mounted by a rotating shaft coupled to a rotating mechanism to rotate the polishing plate, an expandable elastomer sheet attached to a lower surface of the polishing plate, an abrasive cloth attached to a lower surface of the elastomer sheet, and means for pressing the elastomer sheet at a plurality of positions under respective predetermined different pressures such that a lower surface of the abrasive cloth is deformed to the desired inverted convex shape in accordance with differences of pressing force applied to the elastomer sheet at the plurality of positions, resting a substrate on a substrate holder and securing it thereto, bringing the inverted convexly deformed surface of the abrasive cloth in contact with the substrate, and rotating and moving the working tool for polishing the substrate over a selected area, wherein the substrate is a synthetic quartz glass substrate having a diagonal length of at least 1,000 mm.

2. The method of claim 1 wherein the pressing means includes a plurality of bores perforated in the polishing plate and arranged symmetrical about its center, a plurality of cylinders inserted in the bores, and a plurality of pistons slidably fitted in the cylinders, wherein as the pistons are selectively descended, the elastomer sheet is forced downward at sites opposed to the pistons in accordance with descending distances of the pistons whereby a selected region of the abrasive cloth is protruded downward to form the desired inverted convex shape.

3. The method of claim 1 wherein the elastomer sheet is made of an expandable elastomer selected from the group consisting of silicone rubber, polyurethane rubber, neoprene rubber, and isoprene rubber.

4. The method of claim 1 wherein the abrasive cloth is non-woven fabric, suede or expanded polyurethane.

* * * * *